US012274358B2

(12) United States Patent
Ng

(10) Patent No.: US 12,274,358 B2
(45) Date of Patent: Apr. 15, 2025

(54) STORAGE RACK ASSEMBLY

(71) Applicant: LEYO HOLDINGS SDN BHD, Batu Pahat (MY)

(72) Inventor: Teck Lai Ng, Johor Bahru (MY)

(73) Assignee: Leyo Holdings Sdn Bhd, Batu Pahat (MY)

( * ) Notice: Subject to any disclaimer, the term of this patent is extended or adjusted under 35 U.S.C. 154(b) by 0 days.

(21) Appl. No.: 18/513,591

(22) Filed: Nov. 19, 2023

(65) Prior Publication Data

US 2024/0260746 A1 Aug. 8, 2024

(30) Foreign Application Priority Data

Feb. 3, 2023 (MY) ..... 2023000565

(51) Int. Cl.

| | |
|---|---|
| ***A47B 55/00*** | (2006.01) |
| ***A47B 47/00*** | (2006.01) |
| ***A47B 47/02*** | (2006.01) |
| ***A47B 57/20*** | (2006.01) |
| ***A47B 91/02*** | (2006.01) |

(52) U.S. Cl.

CPC ..... *A47B 55/00* (2013.01); *A47B 47/0083* (2013.01); *A47B 47/024* (2013.01); *A47B 57/20* (2013.01); *A47B 91/02* (2013.01)

(58) Field of Classification Search

CPC ..... A47B 55/00; A47B 47/0083; A47B 91/02; A47B 57/06; A47B 57/12; A47B 57/20; A47B 47/024; A47B 47/028; A47B 47/05; A47B 47/06; A47B 43/04; A47B 47/025

USPC ..... 211/153, 133.1, 149, 134, 135

See application file for complete search history.

(56) References Cited

U.S. PATENT DOCUMENTS

| | | | | | |
|---|---|---|---|---|---|
| 1,113,818 | A | * | 10/1914 | O'Brien | A47F 5/13 108/177 |
| 1,705,129 | A | * | 3/1929 | McGoogan | A47B 47/027 211/195 |
| 2,315,595 | A | * | 4/1943 | Chappory | A47F 5/13 211/186 |
| 2,915,196 | A | * | 12/1959 | Olof | A47B 57/425 248/222.51 |
| 2,922,529 | A | * | 1/1960 | Culbertson | A47B 5/06 126/304 R |
| 2,954,125 | A | * | 9/1960 | Husted | A47F 5/0823 108/62 |

(Continued)

FOREIGN PATENT DOCUMENTS

| | | | | | |
|---|---|---|---|---|---|
| AU | 8930917 | A | * | 9/1989 | A47B 55/02 |
| CN | 204306401 | U | * | 5/2015 | |

(Continued)

*Primary Examiner* — Jennifer E. Novosad

(74) *Attorney, Agent, or Firm* — Preston Smirman; SMIRMAN IP LAW, PLLC

(57) ABSTRACT

A storage rack assembly (100) including a plurality of horizontal panels (101), and a plurality of vertical support rods (102) that connect the horizontal panels (101) and hold each of the horizontal panels (101) at their respective height, wherein each vertical support rod (102) includes a plurality of non-detachable protrusions (103) that are spaced apart from each other along a length of the vertical support rods (102) and each horizontal panel (101) includes a plurality of pre-formed holes (104) for fittably receiving the corresponding protrusions (103) of the vertical support rods (102).

6 Claims, 3 Drawing Sheets

(56) References Cited

U.S. PATENT DOCUMENTS 3,093,247 A * 6/1963 Erickson ..... A47B 43/00 211/149
3,149,727 A * 9/1964 Magers ..... A47F 7/144 211/186
3,184,068 A * 5/1965 Wende ..... A47F 7/04 211/23
3,358,621 A * 12/1967 Szacsko ..... A47B 57/045 108/92
3,650,588 A * 3/1972 Helland ..... A47B 57/20 211/126.15
3,785,301 A * 1/1974 Lundqvist ..... A47B 57/20 108/109
3,967,327 A * 7/1976 Severson ..... A47C 19/12 5/8
4,345,525 A 8/1982 De poorter
4,858,773 A * 8/1989 Zimmerman ..... A21B 1/50 211/195
5,131,547 A * 7/1992 Goldberg ..... A47F 5/13 108/177
5,577,622 A * 11/1996 Kapteyn ..... A47F 5/0025 211/195
6,164,466 A * 12/2000 Baradat ..... B62B 3/006 211/186
6,971,528 B2 * 12/2005 Chen ..... A47B 57/40 211/187
7,191,908 B2 * 3/2007 De Rijk ..... A47B 57/48 211/208
7,832,571 B2 * 11/2010 Felsenthal ..... A47F 5/137 211/134
7,967,156 B2 * 6/2011 Hsu ..... A47B 47/024 211/187
8,333,158 B2 * 12/2012 Wise ..... A47B 57/20 108/134
8,640,893 B2 * 2/2014 Kessell ..... A47B 57/545 211/187
8,915,383 B2 * 12/2014 Pedersen ..... A47G 7/041 211/195
9,282,820 B2 * 3/2016 Lo ..... A47B 87/0207
9,820,572 B1 * 11/2017 Kuehn ..... A47B 47/0083
9,901,169 B1 * 2/2018 Schenker ..... A47B 96/021
11,771,015 B1 * 10/2023 Sale ..... B65D 19/385 211/85.8
11,832,721 B2 * 12/2023 Jerabek ..... A47B 57/545
2008/0156755 A1 * 7/2008 Wang ..... A47B 43/00 211/183
2008/0203042 A1 * 8/2008 Felsenthal ..... A47B 47/027 211/153
2009/0314731 A1 * 12/2009 Hsu ..... A47B 47/024 211/119.003
2011/0068071 A1 * 3/2011 Suman ..... A47F 5/0087 211/153
2011/0120966 A1 * 5/2011 Salzstein ..... B60B 33/0002 16/18 R
2011/0266239 A1 * 11/2011 Daily ..... A47F 5/103 211/149
2014/0167919 A1 * 6/2014 Singh ..... G06K 7/10366 211/149
2015/0096953 A1 * 4/2015 Lai ..... A47B 96/066 211/186
2024/0260746 A1 * 8/2024 Ng ..... A47B 47/0083

FOREIGN PATENT DOCUMENTS

CN 106724055 A * 5/2017
WO WO-2024162840 A1 * 8/2024 ..... A47B 47/00

* cited by examiner

STORAGE RACK ASSEMBLY

CROSS-REFERENCE TO RELATED APPLICATION

The instant application claims priority to Malaysia Patent Application Serial No. PI2023000565 filed Feb. 3, 2023, the entire specification of which is expressly incorporated herein by reference.

FIELD OF THE INVENTION

The present invention relates to a rack assembly. More particularly, the present invention relates to a storage rack assembly.

BACKGROUND OF THE INVENTION

Furniture plays an important aspect in daily life. Furniture assemblies, such as storage racks, have been further developed to suit the needs of people. Storage racks are commonly found in homes and offices for storing and displaying a plethora of items. In recent times, it has become desirable to produce easily assembled storage racks. This allows for common folk to conveniently self-assemble without requiring any special set of skills or tools. Additionally, it is also desirable to produce lightweight and less bulky storage racks for ease of storage and transport of the storage rack.

Various storage racks have been developed throughout the years. An example of the storage rack can be referred to from U.S. Pat. No. 4,345,525A which discloses a furniture structure. The furniture structure comprises at least two vertical framing pieces, at last one horizontal framing piece, each of the vertical framing piece defining two opposed sides with spaced holes in each side and a third side perpendicular to the two sides. The third side having at least one hole perpendicular to the spaced holes. The horizontal framing piece having two opposed sides with spaced holes in each side and at least two holes in the horizontal framing piece, each aligned with one hole in the third said of the vertical framing piece when assembled. A pin fitting within the hole of the third side of the vertical framing piece and the aligned hole of the horizontal framing piece and rigid rods positioned at about 45° with respect to the vertical and horizontal framing pieces and fitting within the holes in the sides of the vertical and horizontal framing pieces. The pin plays an important role in ensuring correct positioning of the framing pieces. The disclosed furniture structure presents a simple assembly of a storage rack using the rigid rods and pins. However, the furniture structure is assembled using relatively bulky framing pieces, which hinders storage and transport of each of the framing pieces. This incurs more costs of packaging during storage and transportation phase after producing the furniture structure. Additionally, the rigid rods may not be sufficient in providing sufficient stability and support for the furniture structure. This may lead to the furniture structure to become slanted or unstable during assembly or usage, which may lead to physical harm to a user or to items placed onto the furniture structure.

Accordingly, it would be desirable to provide a storage rack assembly with easy self-assembly. The proposed invention provides such a solution that solves the abovementioned problems.

SUMMARY OF THE INVENTION

The main objective of the invention is to provide a storage rack assembly with easy self-assembly.

Another objective of the invention is to provide a storage rack assembly with improved structural stability.

The present invention provides a storage rack assembly comprising a plurality of horizontal panels, and a plurality of vertical support rods that connect the horizontal panels and hold each of the horizontal panels at their respective height, characterised in that each vertical support rod comprises a plurality of non-detachable protrusions that are spaced apart from each other along a length of the vertical support rods and each horizontal panel comprises a plurality of pre-formed holes for fittably receiving the corresponding protrusions of the vertical support rods.

Preferably, the storage rack assembly further comprise one or more further (or additional) support rods, each is arranged in a slanted manner to connect at least two horizontal panels, wherein each further (or additional) support rod comprises a plurality of non-detachable protrusions that are spaced apart from each other along a length of the further (or additional) support rods and each horizontal panel comprises a plurality of further (or additional) pre-formed holes for fittably receiving the corresponding protrusions of the further (or additional) support rods.

Preferably, the non-detachable protrusions are welded to the vertical support rods and the further (or additional) support rods.

Preferably, one end portion of each non-detachable protrusion includes a surface profile that conforms with a shape of the vertical support rods or further (or additional) support rods.

Preferably, a bottom end of each vertical support rod is attached with a height adjustable foot.

Preferably, the height adjustable foot is further attached to one end of a connector and the other end of the connector is attached to the bottom end of the vertical support rod.

Preferably, the horizontal panels are fiberboards.

One skilled in the art will readily appreciate that the present invention is well adapted to carry out the objects and obtain the ends and advantages mentioned, as well as those inherent therein. The embodiment described herein is not intended as limitations on the scope of the invention.

BRIEF DESCRIPTION OF THE DRAWINGS

For the purpose of facilitating an understanding of the invention, there is illustrated in the accompanying drawing the preferred embodiments from an inspection of which when considered in connection with the following description, the invention, its construction, and operation and many of its advantages would be readily understood and appreciated.

DETAILED DESCRIPTION OF THE INVENTION

The invention will now be described in greater detail, by way of example, with reference to the drawings.

Figure 1:
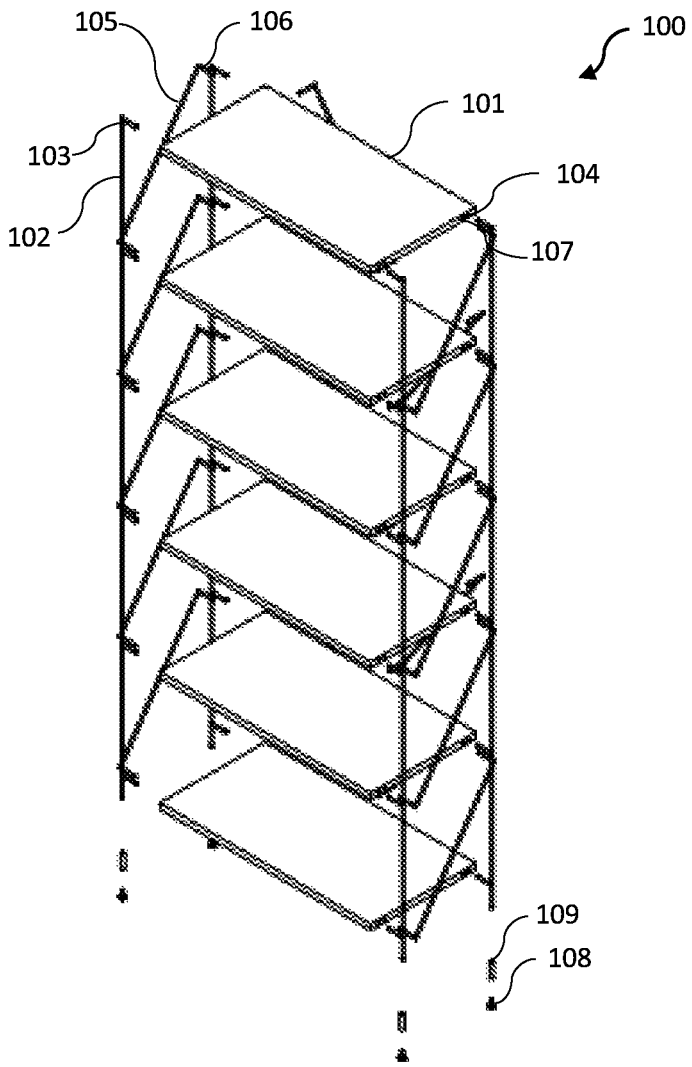
FIG. 1 is a perspective view illustrating an illustrative assembly of a storage rack assembly, in accordance with the general teachings of the present invention.

FIG. 1 illustrates a perspective view diagram of a preferred embodiment of a storage rack assembly 100. A storage rack assembly 100 refers to a storage rack or a racking for storing and displaying items. Generally, the storage rack comprises of at least two vertical frames, horizontal frame, and a form of decking. The decking may be, but is not limited to, bars, panels, or meshes. In the preferred embodiment of the invention, the storage rack assembly 100 comprises a plurality of horizontal panels 101 and a plurality of vertical support rods 102 that connect the horizontal panels 101 and hold each of the horizontal panels 101 at their respective height. Preferably, the horizontal panels 101 are fiberboards. The horizontal panels 101 are made of sturdy and relatively lightweight material to ensure a robust structure and allow for easy transportation of the horizontal panels 101. Additionally, the number horizontal panels 101 used may be selected to suit a user's preferred storage rack height. Alternatively, the horizontal panel 101 can be provided with a recess that converts the respective horizontal panel 101 into a tray.

Figure 2:
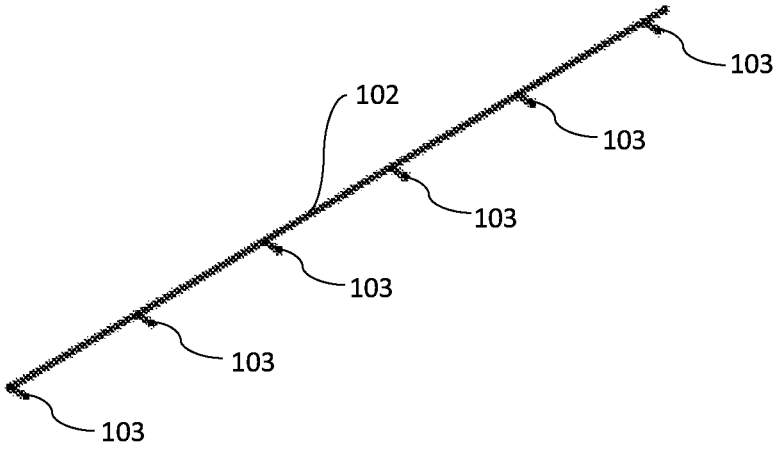
FIG. 2 is a perspective view illustrating a horizontal panel of the storage rack assembly depicted in FIG. 1.
Figure 3:
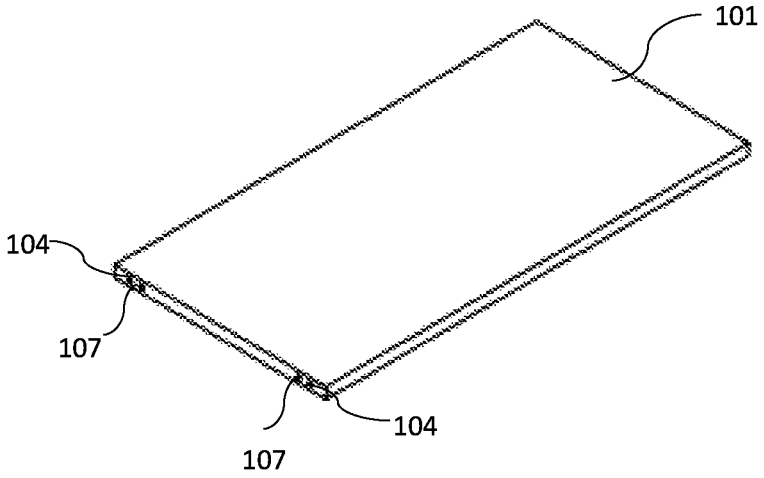
FIG. 3 is a perspective view illustrating a vertical support rod of the storage rack assembly depicted in FIG. 1.

Referring to FIG. 2, each vertical support rod 102 comprises a plurality of non-detachable protrusions 103 that are spaced apart from each other along a length of the vertical support rods. Preferably, the vertical support rod 102 is a steel wire frame. This eases assembly of the storage rack assembly 100 as well as having results a less bulky structure. As depicted in FIG. 3, each horizontal panel 101 comprises a plurality of pre-formed holes 104 for fittably receiving the corresponding protrusions 103 of the vertical support rods 102. Each of the protrusions 103 can be simply inserted into the plurality of pre-formed holes 104 of the horizontal panels 101 to set up the storage rack assembly 100. This permits easy self-assembly without need for any special set of skills or tools, making it convenient for the user.

Figure 4:
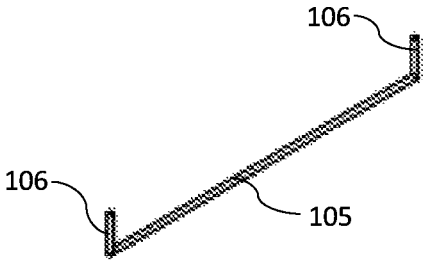
FIG. 4 is a perspective view illustrating a further (or additional) support rod of the storage rack assembly depicted in FIG. 1.

Preferably, each horizontal panel 101 comprises a plurality of further (or additional) pre-formed holes 107. Referring to FIG. 4, the storage rack assembly 100 further comprises one or more further (or additional) support rods 105, each is arranged in a slanted manner to connect at least two horizontal panels 101. Preferably, each further (or additional) support rod 105 comprises a plurality of non-detachable protrusions 106 that are spaced apart from each other along a length of the further (or additional) support rods 105. Preferably, the further (or additional) support rods 105 are steel wire frames. In the preferred embodiment, the plurality of the further (or additional) pre-formed holes 107 fittably receives the corresponding protrusions 106 of the further (or additional) support rods 105. Similar to the vertical support rods 102, the protrusions 106 of the further (or additional) support rods 105 are easily inserted into the further (or additional) pre-formed holes 107 of the horizontal panels 101. The main purpose of the further (or additional) support rods 105 is to provide additional structural stability to the storage rack assembly 100 and to prevent the storage rack assembly 100 from shaking or wobbling. This means that the storage rack assembly 100 does not depend solely on the vertical support rods 102 for structural integrity. Additionally, further (or additional) support rods 105 may be arranged in a manner which adds to stylishness of the storage rack assembly 100.

In the preferred embodiment, the non-detachable protrusions 103, 106 are welded to the vertical support rods 102 and the further (or additional) support rods 105 to respectively form a one-piece unit. This ensures that the non-detachable protrusions 103 are firmly bonded to the vertical support rods 102 and the further (or additional) support rods 105. This minimizes risk of the non-detachable protrusions 103 breaking off from the support rods 102, 105. Hence, this ensures durability of the non-detachable protrusions 103 to support the horizontal panels 101 and any load placed onto the horizontal panels 101 after assembly. Preferably, one end portion of each non-detachable protrusion 103, 106 includes a surface profile that conforms with a shape of the vertical support rods 102 or the further (or additional) support rods 105 to improve the bonding of the non-detachable protrusion 103, 106 to the vertical support rods 102 and the further (or additional) support rods 105 after the welding.

Figure 5:
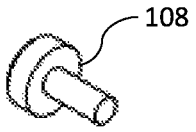
FIG. 5 is a perspective view illustrating a height adjustable foot of the storage rack assembly depicted in FIG. 1.
Figure 6:
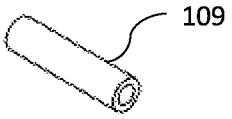
FIG. 6 is a perspective view illustrating a connector of the storage rack assembly depicted in FIG. 1.

FIG. 5 illustrates a height adjustable foot 108. Preferably, a bottom end of each vertical support rod 102 is attached with the height adjustable foot 108. A connector 109 is depicted in FIG. 6. In the preferred embodiment, the height adjustable foot 108 is further attached to one end of the connector 109 and the other end of the connector 109 is attached to the bottom end of the vertical support rod 102. The height adjustable foot 108 may be, but is not limited to, a rubber protector cap, a metal cap, or a plastic cap. The height adjustable foot 108 grip onto a floor, or a surface, where the storage rack assembly 100 is placed onto. This provides additional stability to the bottom end of each vertical support rod 102 in supporting the storage rack assembly 100. Additionally, the height adjustable foot 108 may further include a rubber suction cup to fixedly position the storage rack assembly 100 at a desired placement. This would prevent skidding and undesired movement of the storage rack assembly 100 by an external force. The connector 109 may be made of, but is not limited to, rubber, metal, or plastic. The connector 109 fixes the height adjustable foot 108 to the bottom end of the vertical support rod 102 and minimizes risk of detachment for further structural stability of the storage rack assembly 100.

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

What is claimed is:

1. A storage rack assembly, comprising:

a plurality of horizontal panels; and a plurality of vertical support rods that connect the horizontal panels and hold each of the horizontal panels at their respective height;

one or more additional support rods, each is arranged in a slanted manner to connect at least two horizontal panels;

wherein each vertical support rod and each additional support rod comprises a plurality of non-detachable protrusions that are spaced apart from each other along a length of the vertical support rods and the additional support rods respectively, and each horizontal panel comprises a plurality of pre-formed holes for fittably receiving the corresponding protrusions of the vertical support rods, and a plurality of further pre-formed holes for fittably receiving the corresponding protrusions of the additional support rods.

2. The storage rack assembly according to claim 1, wherein the non-detachable protrusions are welded to the vertical support rods and the additional support rods.

3. The storage rack assembly according to claim 1, wherein one end portion of each non-detachable protrusion includes a surface profile that conforms with a shape of the vertical support rods or the further support rods.

4. The storage rack assembly according to claim 1, wherein a bottom end of each vertical support rod is attached with a height adjustable foot.

5. The storage rack assembly according to claim 4, wherein the height adjustable foot is further attached to one end of a connector while the other end of the connector is attached to the bottom end of the vertical support rod.

6. The storage rack assembly according to claim 1, wherein the horizontal panels are fiberboards.

* * * * *